US008457505B2

(12) United States Patent
Mochizuki

(10) Patent No.: US 8,457,505 B2
(45) Date of Patent: Jun. 4, 2013

(54) IMAGE FORMING APPARATUS WITH HEATER CONTROL AND ERROR DETECTION, AND CONTROL METHOD FOR THE SAME

(75) Inventor: Masayuki Mochizuki, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 195 days.

(21) Appl. No.: 12/850,048

(22) Filed: Aug. 4, 2010

(65) Prior Publication Data

US 2011/0052217 A1 Mar. 3, 2011

(30) Foreign Application Priority Data

Sep. 1, 2009 (JP) ..... 2009-201450

(51) Int. Cl.
*G03G 15/00* (2006.01)

(52) U.S. Cl.
USPC ..... 399/10; 399/33; 399/37; 399/88

(58) Field of Classification Search
USPC ..... 399/10, 33, 37, 88
See application file for complete search history.

(56) References Cited

U.S. PATENT DOCUMENTS 5,802,421 A * 9/1998 Miura ..... 399/33
2005/0058467 A1 * 3/2005 Sasamoto et al.
2007/0085872 A1 4/2007 Teradaira

FOREIGN PATENT DOCUMENTS

JP 04085657 A * 3/1992
JP 8-69327 A 3/1996
JP 2000-122477 4/2000
JP 2007-111882 A 5/2007

* cited by examiner

*Primary Examiner* — David Gray
*Assistant Examiner* — Laura Roth
(74) *Attorney, Agent, or Firm* — Smith, Gambrell & Russell, LLP

(57) ABSTRACT

An image forming apparatus according to the present invention includes: a fixing part having a heater; a control part controlling ON/OFF of power distribution to the heater; a power source part generating a voltage for driving the control part; a main switch for turning ON/OFF power supply from outside to the power source part; and an interrupt signal generation part generating a periodical interrupt signal. The control part, based on the interrupt signal, controls ON/OFF of the power distribution to the heater, turns OFF power supply to the heater upon passage of predetermined time since disappearance of the interrupt signal, and judges that an error has occurred, when the control part is still driving after passage of driving stop time from when the main switch is turned OFF to when the control part stops its driving since the disappearance of the interrupt signal.

14 Claims, 6 Drawing Sheets

(IN NORMAL CONDITION)

(IN ABNORMAL CONDITION)

IMAGE FORMING APPARATUS WITH HEATER CONTROL AND ERROR DETECTION, AND CONTROL METHOD FOR THE SAME

This application is based upon and claims the benefit of priority from the corresponding Japanese Patent Application No. 2009-201450 filed on Sep. 1, 2009, the entire contents of which are incorporated herein by reference.

BACKGROUND OF THE INVENTION

1. Field of the Invention

The invention relates to an image forming apparatus such as a multi-function peripheral, a copier, a printer or a fax machine provided with a fixing part which is provided with a heater heated through power distribution (energization) and which heats a toner image to fix it.

2. Description of Related Art

Typically, a xerographic image forming apparatus (printer, copier, facsimile, or the like) is provided with a fixing part that heats and pressurizes a toner image formed on a sheet to fix it. Moreover, the fixing part is provided with a heater heated through power distribution for the purpose of heating the toner image. A control part or a control unit in the image forming apparatus turns ON/OFF power distribution to the heater to keep the fixing part at an appropriate temperature. Here, for example, a circuit is provided which generates a periodical interrupt signal such as a zero cross signal of an AC voltage applied to the heater. Then for precise control of the power distribution to the heater, based on the interrupt signal, the control part or the like may perform ON/OFF control of the power distribution to the heater. For example, the control part or the like turns ON/OFF the heater with a rising edge or a trailing edge of the interrupt signal as a trigger.

Disclosed is an image forming apparatus which generates a zero cross signal as such an interrupt signal. Specifically, disclosed is an image forming apparatus including: a power source unit outputting a DC voltage based on AC input; an electrical load driven by the AC input; an error detector driven by the DC voltage; an AC input interruption detector detecting AC input interruption; and an error processor that, when an error has been detected, examines with the AC input interruption detector whether or not the AC input is in an interrupted state and ignores this error if the AC input is in the interrupted state, wherein the AC input interruption detector includes: a zero cross signal generator generating a zero cross signal of the AC input; a means adapted to periodically count the zero cross signal; a means adapted to measure time that has passed since a count value of the zero cross signal was cleared to zero; and a means adapted to determine that the measured time has become larger than a predetermined value before the count value of the zero cross signal reaches a predefined value. With this configuration, an attempt is made to prevent occurrence of erroneous error detection following unexpected AC input interruption.

For example, in performing the ON/OFF control of the heater in the fixing part by using the interrupt signal such as the zero cross signal, the interrupt signal may stop (disappear) due to, for example, failure or reckless driving of the circuit generating the interrupt signal. Here, the control part or the like switches ON/OFF of the heater with the rising edge or the trailing edge of the interrupt signal as the trigger. Therefore, the stop of the interrupt signal in a state in which the power distribution to the heater is ON maintains the state that the power distribution to the heater is ON. In that case, the heater continuously heats up and turns into a temperature-excessively-raised state, causing, for example, melting of a member in the fixing part. Then, upon passage of a certain period of time since the disappearance of the interrupt signal, the control part or the like may judge that an error has occurred, thus turning OFF the power distribution to the heater.

On the other hand, in the image forming apparatus, a power source part may be provided. The power source part receives power supply from a commercial power source or the like, performs rectification, stepping down, etc. to generate a plurality of kinds of voltages (for example, DC voltages for driving the control part and for supply to a motor). This power source part typically includes an element, such as a smoothing capacitor or the like, that stores energy; therefore, even when a main power source of the image forming apparatus has been turned OFF, due to discharge from the capacitor or the like, the control part may continue to drive for a certain period of time (for example, several seconds). Moreover, as a result of turning OFF the main power source, the interrupt signal such as the zero cross signal is no longer generated. However, if the control part or the like is still driving at a time point at which the control part or the like has judged the error after the disappearance of the interrupt signal, the control part erroneously detects that an error of interrupt signal stop has occurred. This raises a problem that unnecessary operations, for example, error display on a display part, storage of a history of the error detection into a storage part, etc. are performed.

Since the conventional image forming apparatus described above has the error processor that ignores the error when the AC input interruption has been detected, it seems that the aforementioned problem does not occur. However, the image forming apparatus described above counts the zero cross signal and the time, and when the measured time has become larger than the predetermined value before the count value of the zero cross signal reaches the predefined value, determines the AC input interruption. Therefore, even when the AC input is continuously inputted due to, for example, failure or disconnection in the zero cross signal generator, it is judged as the AC input interruption. In other words, even when the zero cross signal stops due to failure occurring in the zero cross signal generation circuit in a state in which the main power source is ON, the error is ignored. In that case, the power distribution to the heater may be continuously ON, thus causing excessive temperature rise at the fixing part. Therefore, in the conventional image forming apparatus, in terms of safety, a problem worse than the performance of the unnecessary operations arises.

SUMMARY OF THE INVENTION

In view of the aforementioned problem of the conventional art, it is an object of the invention to reliably prevent excessive temperature rise at a fixing part by turning OFF power distribution to a heater upon passage of a predetermined period of time since disappearance of an interrupt signal regardless of whether a main power source is ON or OFF and also to prevent unnecessary operations from being performed due to failure to stop driving of a control part immediately after the main power source has been turned OFF.

To achieve an image forming apparatus according to an aspect of the present invention includes: a fixing part including: a heating body incorporating a heater heated through power distribution, the heating body heating paper with a toner image transferred thereon, and a pressurizing body making pressure-contact with the heating body and pressurizing the paper with the toner image transferred thereon; a power source part receiving power supply from outside and then supplying power to the heater and generating a voltage for driving a control part; a main switch for turning ON/OFF the power supply from the outside to the power source part; an interrupt signal generation part generating a periodical interrupt signal based on the power supplied from the outside; and a control part controlling ON/OFF of the power distribution to the heater based on the interrupt signal from the interrupt signal generation part, turning OFF power supply to the heater upon passage of predetermined time since disappearance of the interrupt signal, and judges that an error has occurred when the control part is still driving after passage of driving stop time since the disappearance of the interrupt signal from the interrupt signal generation part, the driving stop time corresponding to time longer than the predetermined time and time from when the main switch is turned OFF to when the control part stops driving thereof.

According to this aspect, the power distribution to the heater is turned OFF upon the passage of the predetermined time since the disappearance of the interrupt signal. Further, the control part, when still driving after the passage of the driving stop time since the disappearance of the interrupt signal, judges that an error has occurred. As a result, even when the main power source has been turned OFF, the control part continues to drive for a certain period of time, thereby permitting prevention of the unnecessary operations from being performed.

While the heating body of the fixing part is kept at an appropriate temperature for fixing (fixing control temperature) except for in a power-save mode, the "predetermined time" can be defined within a range shorter than time when a temperature identified as an excessively increased temperature is reached from the fixing control temperature as a result of melting or the like occurring at the heating body, the pressurizing body, a member supporting the heating body, etc. after the power distribution to the heater. Moreover, the "driving stop time" differs depending on the type of an image forming apparatus due to differences in current consumption at the control part, configuration of the power source part, etc., and thus can be defined by recognizing through an experiment or the like time from when the main power source has been turned OFF under the condition that the main power source is ON to when the control part stops its driving.

Further features and advantages of the invention will be more clarified by embodiments described below.

DETAILED DESCRIPTION OF PREFERRED EMBODIMENTS

Hereinafter, an embodiment of the present invention will be described with reference to FIGS. 1 to 6. Note that elements such as configuration and arrangement described in the embodiment do not limit the scope of the invention and thus simply serve as illustrative examples.

(Outline Configuration of a Multi-Function Peripheral 100)

Figure 1:
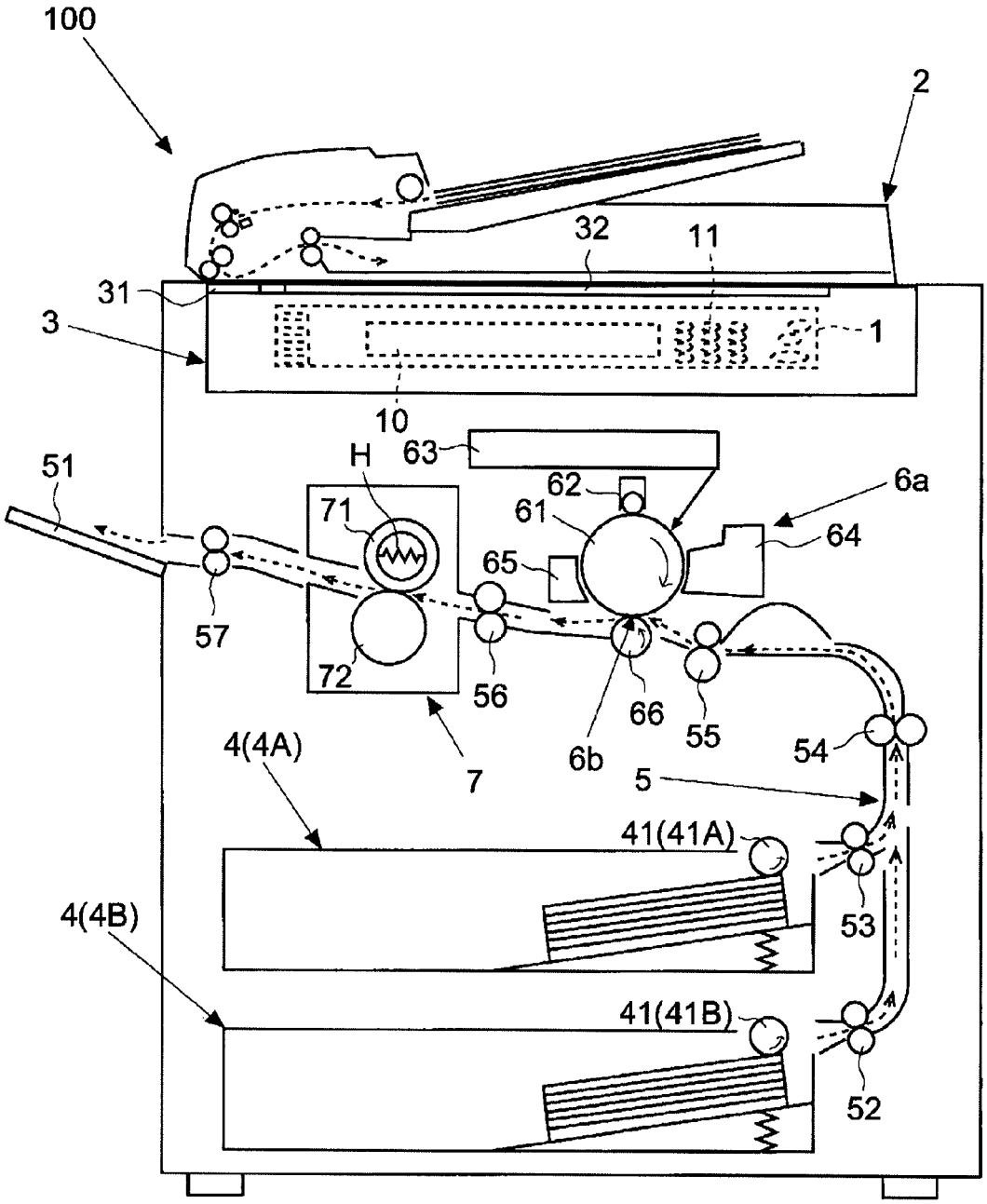
FIG. 1 is a schematic elevation sectional view showing one example of a multi-function peripheral according to an embodiment of the invention.

First, referring to FIG. 1, an outline of a multi-function peripheral 100 (corresponding to an image forming apparatus) of a xerographic, digital type according to the embodiment of the invention will be described. FIG. 1 is a schematic elevation sectional view showing one example of the multi-function peripheral 100 according to the embodiment of the invention.

As shown by broken lines in FIG. 1, the multi-function peripheral 100 of this embodiment has an operation panel 1 (corresponding to a display part) at the top in an elevation view. The operation panel 1 is provided with: a liquid crystal display part 10 of a touch-panel type displaying a setting screen where various setting keys are indicated, a status of the multi-function peripheral 100, an error message, etc.; and various keys of, for example, a ten key part 11 for numerical input.

At a topmost part of the multi-function peripheral 100 of this embodiment, a document conveying device 2 is provided. Below the document conveying device 2 and in a main body of the multi-function peripheral 100, an image reading part 3, a paper feed part 4, a conveying path 5, an image forming part 6, a fixing part 7, etc. are provided.

First, the document conveying device 2 automatically and continuously conveys a document subjected to image reading toward a document-delivered reading contact glass 31 (a reading position) at the top of the image reading part 3. Provided inside the image reading part 3 below the document conveying device 2 are: optical members including an exposure lamp, a mirror, a lens, an image sensor, etc. (not shown).

Contact glasses at the top of the image reading part 3 are broadly classified into two. In FIG. 1, the document-delivered reading contact glass 31 is arranged on the left side and a document-placed reading contact glass 32 is arranged on the right side. To a document passing through the document-delivered reading contact glass 31 and a document placed on the document-placed reading contact glass 32, the exposure lamp irradiates light, and reflection light of the document is guided by the mirror and the lens to the image sensor. Then the image sensor converts an optical signal into an electrical signal for each pixel, whereby image data of the document is obtained. For example, in the multi-function peripheral 100, printing is performed based on the image data obtained at the image reading part 3 (copy function).

The paper feed part 4 is provided at a lowermost part of the multi-function peripheral 100 and has various types of paper (for example, copy paper, recycled paper, coat paper, etc.) of different sizes (letter size, A-type paper, B-type paper, etc.) loaded for storage. The paper feed part 4 supplies the paper upon printing. The paper feed part 4 can be plurally provided (an upper one is a paper feed part 4A and a lower one is a paper feed part 4B in FIG. 1).

In the paper feed part 4, paper feed rollers 41 are provided (an upper one is marked with numeral 41A and a lower one is marked with numeral 41B in FIG. 1). Each of the paper feed rollers 41 makes contact with the topmost paper. Each paper feed roller 41 is driven by a motor (not shown) into rotation in a predetermined direction (counterclockwise in FIG. 1) and delivers the paper to the conveying path 5 on a one-by-one basis.

The conveying path 5 is a path through which the paper supplied from the paper feed part 4 is conveyed to a discharge tray 51. For paper conveyance inside the apparatus, provided in the conveying path 5 are: in order from the upstream side, handling parts 52 and 53, a conveying roller pair 54, and a registration roller pair 55. Downstream of the registration roller pair 55, the image forming part 6, a transfer part 6*b*, the fixing part 7, etc. are provided. A conveying roller pair 56 is provided between the transfer part 6*b* and the fixing part 7 and a discharge roller pair 57 is provided downstream of the fixing part 7.

The handling parts 52 and 53 have an upper roller rotating in a forward direction and a lower roller rotating in a backward direction to thereby prevent paper multi-feed. The conveying roller pair 54 and the conveying roller pair 56 are pairs of paper-conveying rollers. Each of the conveying roller pairs is driven into rotation and performs paper conveyance. The registration roller pair 55 delivers paper in a manner timed to a toner image formed in the image forming part 6.

The image forming part 6 forms the toner image based on the image data obtained in the image reading part 3 or image data transmitted from a computer 200 located outside. Specifically, the image forming part 6 is provided with: a photosensitive drum 61, a charging device 62, an exposure device 63, a developing device 64, a cleaning device 65, etc. disposed around the photosensitive drum 61.

The photosensitive drum 61 is provided at a substantially central part of the image forming part 6 and so supported as to be rotatable in a direction of an arrow shown in the same figure. The charging device 62 is provided above of the photosensitive drum 61 and charges a surface of the photosensitive drum 61 to a predetermined potential. The exposure device 63 is, for example, a laser scanning unit, which irradiates the surface of the photosensitive drum 61 with light to perform scanning and exposure. As a result of this, an electrostatic latent image is formed. The developing device 64 is provided on the right side of the photosensitive drum 61, and charges a toner and supplies the toner to the electrostatic latent image on the photosensitive drum 61 for development.

The fixing part 7 is provided downstream of the image forming part 6 and the transfer part 6*b* in a paper conveyance direction. The fixing part 7 incorporates a heater H heated through power distribution. The fixing part 7 includes: a heating roller 71 (corresponding to a heating body) that heats paper with a toner image transferred thereon; and a pressurizing roller 72 (corresponding to a pressurizing body) forming a nip in pressure-contact with the heating roller 71 and pressurizing the paper with the toner image transferred thereon. Note that for the heater H, any of various types of heat generating bodies such as a halogen heater, an electrically-heated wire, an IH heater, etc. can be used.

With this configuration, the fixing part 7 heats and pressurizes the paper to fix the toner image. The heating roller 71 and the pressurizing roller 72 rotate to convey paper entering into the nip. Upon passage through the nip, the paper is heated and pressurized whereby the toner is melted and heated to fix the toner image onto the paper. The paper through the fixing part 7 is discharged onto the discharge tray 51, thereby completing image forming processing (printing).

(Hardware Configuration of the Multi-Function Peripheral 100)

Figure 2:
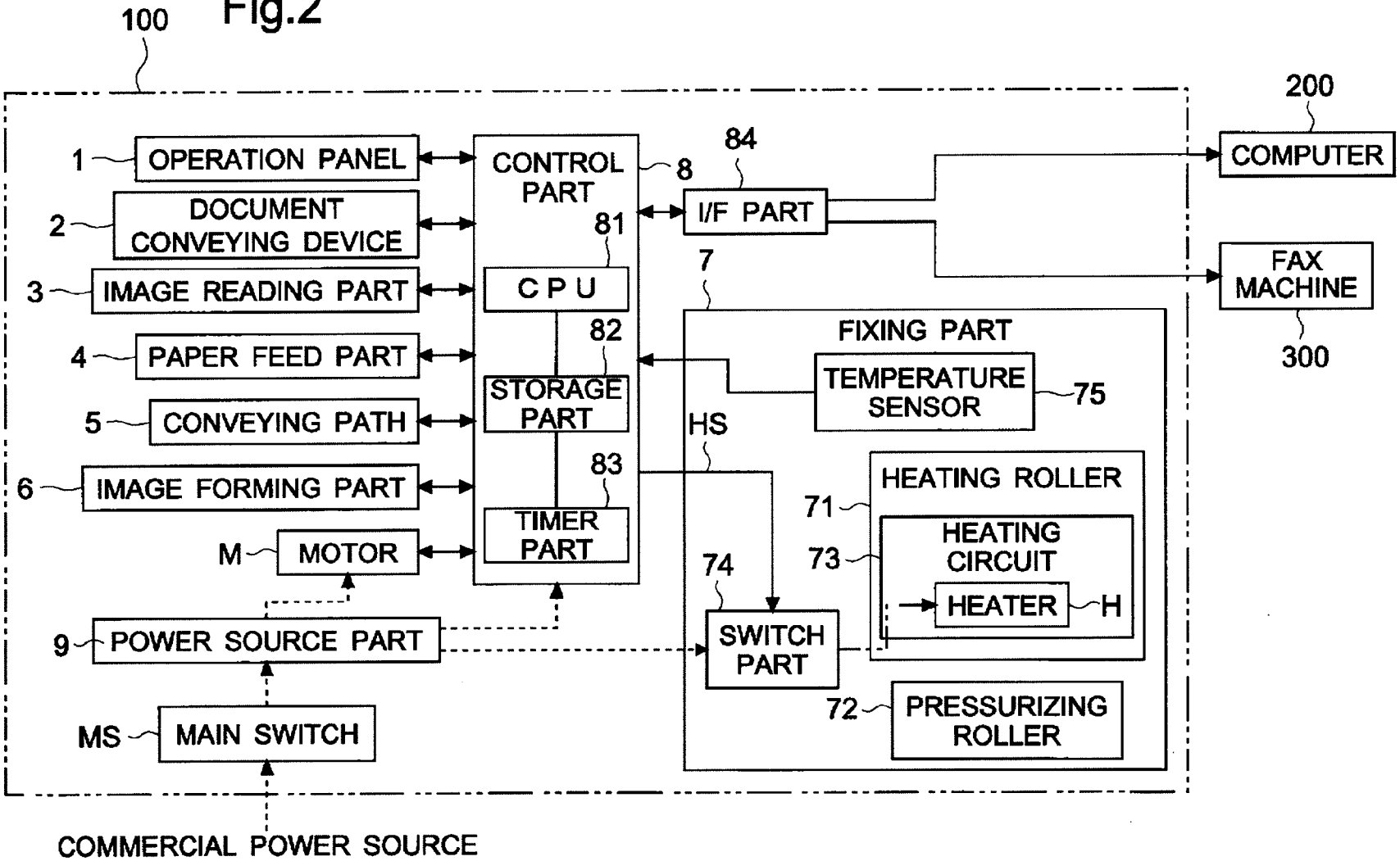
FIG. 2 is a block diagram showing one example of hardware configuration of the multi-function peripheral according to the embodiment of the invention.

Next, based on FIG. 2, one example of hardware configuration of the multi-function peripheral 100 according to the embodiment of the invention will be described. FIG. 2 is a block diagram showing one example of the hardware configuration of the multi-function peripheral 100 according to the embodiment of the invention.

First, as shown in FIG. 2, provided in the multi-function peripheral 100 of this embodiment is a control part 8 that controls overall operation of the multi-function peripheral 100, for example, controls OF/OFF of power distribution to the heater H. Note that the control part 8 may be provided in a plurality of kinds divided for different functions, including: a main control part that performs overall control and image processing; an engine control part that performs image formation, turning ON/OFF of a motor or the like rotating various rotors, etc. to control printing; a fixing control part that performs temperature control and rotation control of the heating roller 71 in the fixing part 7; and so on. In this description, these control parts will be shown and described as one control part in a collected form.

A CPU 81 is provided as a central processing unit in the control part 8. Also provided in the control part 8 is a storage part 82 composed of a RAM (Random Access Memory), a ROM (Read Only Memory), a flash ROM, an HDD (Hard Disk Drive), etc. The storage part 82, upon occurrence of an error, stores the occurrence of the error as a history.

For example, the ROM, the flash ROM, and the HDD of the storage part 82 store programs and data required for the control part 8 to perform various controls. The RAM temporarily explores, for example, programs and data for the controls, image data, etc. In the invention, also stored in the storage part 82 are programs and data related to: the control of the power distribution to the heater H; maintenance of the fixing part 7 (the heating roller 71) at an appropriate temperature; and prevention of excessive temperature rise at the heating roller 71. When the control part 8 has detected occurrence of an error, a history (history data) indicating details of the detected error, date and time thereof, etc. are stored into the storage part 82. In the control part 8, a timer part 83 for measuring time required for the various controls can be provided.

The control part 8 is connected by a bus or the like to the operation panel 1, the document conveying device 2, the image reading part 3, the paper feed part 4, the conveying path 5, the image forming part 6, the fixing part 7, a power source part 9, etc. to perform operation control of the various connected parts.

Moreover, an I/F part 84 (interface part) is fitted or connected to the control part 8. Using this I/F part 84, the computer 200 (for example, personal computer) located outside and the multi-function peripheral 100 are connected together by a network or the like in such a manner as to be communicatable with each other. As a result, the multi-function peripheral 100 of this embodiment can, in response to transmission of image data and print setting data from the computer 200 located outside, can perform printing (print function). The multi-function peripheral 100 can also transmit to the computer 200 located outside the image data of the document obtained through reading by the image reading part 3 (scan function). Moreover, the I/F part 84 is provided with a circuit (a modem or the like) for FAX communication, a chip, etc. and can perform transmission and reception of various data including image data to and from a FAX machine 300 at the other end via a public line or the network (FAX function). To the multi-function peripheral 100, a plurality of computers 200 and a plurality of FAX machines 300 located outside can be connected, but only one each is illustrated in FIG. 2 for convenience.

Also in the multi-function peripheral 100 of this embodiment one or more of motors M are provided which rotate the various rotors including, for example, the heating roller 71, the photosensitive drum 61, the paper feed roller 41, the various roller pairs in the conveying path 5, etc. (only one is illustrated in FIG. 2 for convenience). The control part 8, upon printing, drives one or more of motors M to perform paper feed, paper conveyance, toner image formation, fixing, etc.

Moreover, as shown in FIG. 2, the control part 8 of the multi-function peripheral 100 of this embodiment also performs control of the fixing part 7. In the fixing part 7 of this embodiment, for example, a heating circuit 73 for the power distribution to the heater H incorporated in the heating roller 71 is provided. To the heating circuit 73, a switch part 74 is connected which switches between ON and OFF of the power distribution to the heater H.

A heater control signal line HS from the control part 8 is connected to the switch part 74. For example, the CPU 81 of the control part 8, with this heater control signal line HS, inputs to the switch part 74 a signal indicating the ON/OFF control of the power distribution to the heater H (heater driving control signal). As a result, the power distribution to the heater H is turned ON/OFF. Note that the switch part 74 is, for example, a triac, but is not limited thereto as long as it can turn ON/OFF the power distribution with the heater driving control signal.

Also provided in the multi-function peripheral 100 is a temperature sensor 75 arranged inside the fixing part 7 for measuring the temperature of the heating roller 71. An output voltage of the temperature sensor 75 is inputted to the control part 8. For example, the temperature sensor 75 includes a thermistor that makes contact with the heating roller 71 (it may not make contact with the heating roller 71). The thermistor changes its resistance value depending on a temperature, and thus the output voltage of the temperature sensor 75 changes depending on the temperature of the heating roller 71. The control part 8 performs A/D conversion on the output voltage of the temperature sensor 75 (an A/D converter may be provided separately) and recognizes the temperature of the heating roller 71 (fixing part 7) based on a volume of the output voltage.

For example, the storage part 82 stores data table indicating correspondence relationship between the volume of the output voltage of the temperature sensor 75 and the temperature of the heating roller 71. Alternatively, the storage part 82 stores data table indicating the volume of the output voltage of the temperature sensor 75 and the resistance value of the thermistor, and correspondence relationship between the resistance value of the termistor and the temperature of the heating roller 71. The control part 8, with reference to the data table in the storage part 82, recognizes the temperature of the heating roller 71 based on the output voltage of the temperature sensor 75.

The control part 8 recognizes the present temperature of the fixing part 7 (heating roller 71), and then after the power is turned ON, excluding a case where the temperature of the fixing part 7 is kept low as a result of shift to a power-save mode (for example, sleep mode), controls the power distribution to the heater H with the heater driving control signal and performs temperature control in such a manner as to maintain the temperature of the heating roller 71 at a fixing control temperature. The "fixing control temperature" is a temperature of the heating roller 71 to be kept upon printing and also a temperature (for example, approximately 180 to 240 degrees Celsius) suitable for fixing the toner image. Considering toner melting characteristics, materials of the heating roller 71 and the pressurizing roller 72, etc., through an experiment or the like, the temperature suitable for fixing the toner image (fixing control temperature) is previously set for each type of the image forming apparatus.

An outline of the control for maintaining the fixing control temperature will be described. For example, if the temperature of the heating roller 71 is lower than the fixing control temperature when a main power source has been turned ON, the control part 8 performs the power distribution to the heater H to warm up the heating roller 71. Then upon recognition based on the output voltage of the temperature sensor 75 that the temperature of the heating roller 71 has become higher than the fixing control temperature, the control part 8 provides directions to turn OFF the power distribution to the heater H. Then upon recognition that the temperature of the heating roller 71 has become lower than the fixing control temperature, the control part 8 transmits to the switch part 74 directions to turn ON the power distribution to the heater H. As described above, in such a manner as to maintain the fixing control temperature, the control part 8 repeatedly turns ON/OFF the power distribution to the heater H with the switch part 74.

Also provided in the multi-function peripheral 100 of this embodiment is a main switch MS for turning ON/OFF power supply from the outside to the power source part 9. In other words, the user can turn ON and shut off the main power source of the multi-function peripheral 100 by using the main switch MS. When the main power source has been turned ON by the main switch MS, as shown by a broken line in FIG. 2, power is supplied from a commercial power source to the power source part 9. The power source part 9, in response to the power supply from the outside (in response to the supply of the commercial power source), supplies the power to the heater H and also generates a voltage for driving the control part. Moreover, the power source part 9 can generate, for example, a voltage for driving the motor (to be described in detail later). Moreover, the power source part 9 is connected to the switch part 74 of the fixing part 7. When the switch part 74 is in an ON state, the commercial power source is connected to the heater H of the fixing part 7 via the power source part 9. Consequently, the power is supplied to the heater H (to be described in detail later).

(Details of the Power Source Part 9)

Figure 3A:
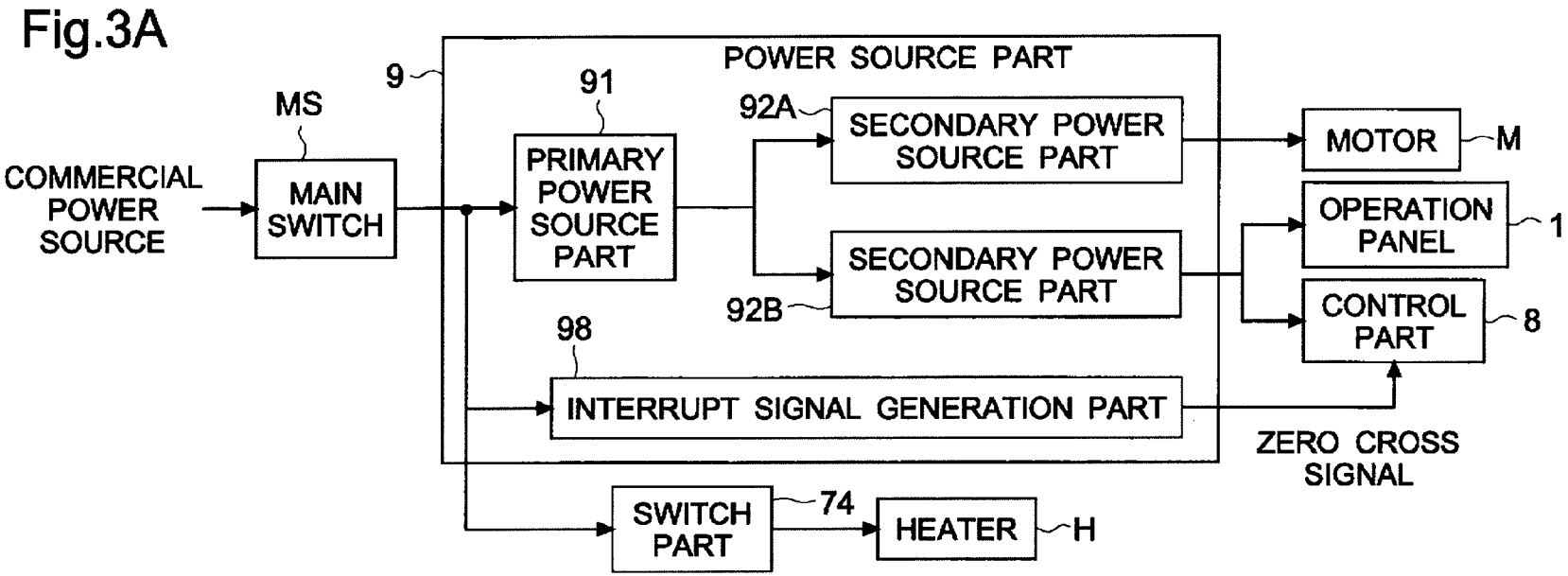
FIG. 3A is a block diagram showing one example of configuration of power source parts and power supply relationship in the multi-function peripheral according to the embodiment.
Figure 3B:
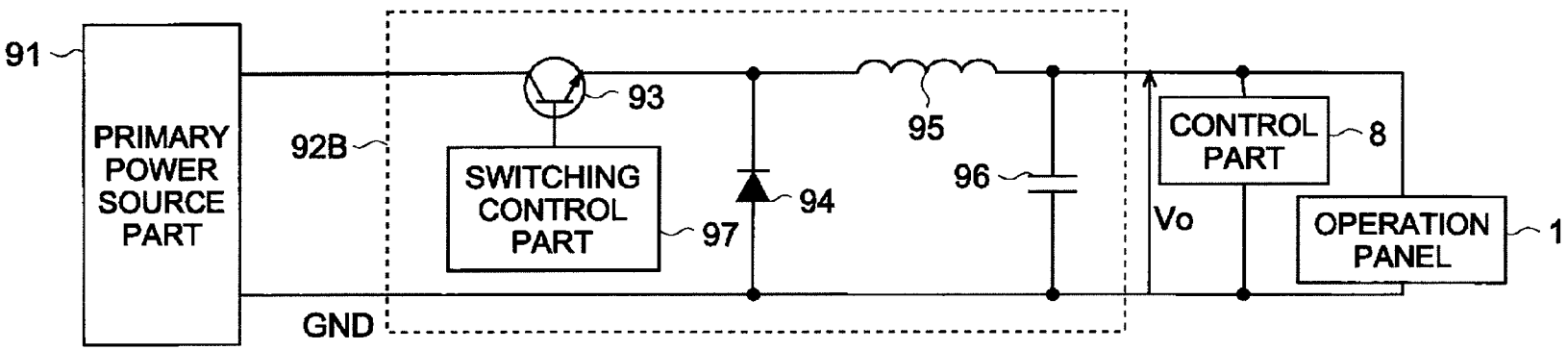
FIG. 3B is a circuit diagram showing one example of a secondary power supply part that generates a voltage supplied to a control part.

Next, based on FIGS. 3A and 3B, one example of the power source part 9 of the multi-function peripheral 100 according to the embodiment of the invention will be described. FIG. 3A is a block diagram showing one example of relationship between configuration of the power source part 9 and the power supply in the multi-function peripheral 100 according to the embodiment of the invention. FIG. 3B is a circuit diagram showing one example of a secondary power source part 92B generating a voltage to be supplied to the control part 8.

First, based on FIG. 3A, one example of the internal configuration of the power source part 9 will be described. To the power source part 9, the power is supplied from the commercial power source when the main switch MS is ON. In the power source part 9, a primarily power source part 91 is provided.

The primarily power source part 91 is a rectifying circuit that rectifies an AC supplied from the commercial power source to a DC. For example, the primarily power source part 91 can be formed of a full-wave rectifying circuit having a diode bridge, a coil and a capacitor as a smoothing circuit. Note that the configuration of the primarily power source part 91 is not limited to that described above, and thus any configuration, for example, configuration such that a transformer is incorporated, is applicable as long as the primarily power source part 91 can perform the rectification.

A DC voltage outputted by the primarily power source part 91 is inputted to secondary power source parts 92A and 92B. The secondary power source parts 92A and 92B can be composed of, for example, a DC-DC convertor and a regulator. The secondary power source part 92A generates, for example, a DC voltage (for example, DC 24V) for driving the motor and supplies it to the motor M. On the other hand, the secondary power source part 92B steps down the voltage inputted from the primarily power source part 91 to generate a DC voltage (for example, DC 5V or DC 3.3V) for driving the CPU 81 and the storage part 82 of the control part 8, and supplies it to the control part 8, the operation panel 1, etc. As described above, the primarily power source part 91, the secondary power source part 92A, and the secondary power source part 92B each serve as a power conversion circuit.

Next, based on FIG. 3B, one example of the circuit of the secondary power source part 92B generating the voltage to be supplied to the control part 8, etc. will be described. The circuit of the secondary power source part 92B shown in FIG. 3B is a chopper-type DC-DC converter. The secondary power source part 92B is composed of for example, a transistor 93 as a switching element, a diode 94, a choke coil 95, and a capacitor 96 in combination. That is, the power source part 9 has the capacitor 96, and based on the power supplied from the outside, performs rectification and stepping-down to generate the voltage for driving the control part. For example, to output of the secondary power source part 92B, the control part 8 and the operation panel 1 are connected.

When the transistor 93 has turned ON, a current flows and the choke coil 95 and the capacitor 96 store energy. When the transistor 93 has turned OFF, the choke coil 95 and the capacitor 96 release the stored energy. A base of the transistor 93 is connected to a switching control part 97. The switching control part 97 performs ON/OFF switching of the transistor 93 in a manner such that an output voltage Vo of the secondary power source part 92B becomes equal to a volume of the voltage supplied to the control part 8, etc. In other words, the switching control part 97 controls a duty factor of the transistor 93. Alternatively, without providing the switching control part 97, with the CPU 81 of the control part 8 connected to the base of the transistor 93, the CPU 81 of the control part 8 may perform the switching of the transistor 93 to control a volume of the output voltage Vo of the secondary power source part 92B.

Moreover, as shown in FIG. 3A, at a later stage than the main switch MS inside the power source part 9 (may be outside of the power source part 9), an interrupt signal generation part 98 is provided. The interrupt signal generation part 98, based on the power supplied from the outside (for example, the commercial power source), generates a periodical interrupt signal. Specifically, the interrupt signal generation part 98 generates a zero cross signal of an AC voltage of the commercial power source. That is, the power source part 9 receives the power supply from the commercial power source, and the interrupt signal generation part 98, based on the voltage of the commercial power source, generates the zero cross signal as the interrupt signal. For example, when the AC voltage has turned to zero, the zero cross signal rises (turns to be high).

For example, the interrupt signal generation part 98 generating the zero cross signal is a circuit using a photocoupler having a phototransistor and two LEDs. One of the LEDs lights up when the AC voltage is positive, and the other one of the LEDs lights up when the AC voltage is negative. To an emitter of the phototransistor, the power source is connected via a resistor. The emitter of the phototransistor serves as output of the interrupt signal generation part 98. In case of this circuit, when the AC voltage has turned to almost zero and the LEDs have turned OFF, the phototransistor is turned OFF, and High is outputted. On the other hand, when the LEDs have lit up, the phototransistor turns ON and potential of the emitter turns to a substantially ground level, and Low is outputted.

As described above, since the interrupt signal is generated from the AC voltage of the commercial power source, the periodical interrupt signal can be inputted to the control part 8 regardless of, for example, a decrease in a processing speed of the control part 8. The interrupt signal generation part 98 may generate a clock in a fixed cycle independently of the AC of the commercial power source. How the zero cross signal is used will be described later.

To the switch part 74, the AC voltage from the main switch MS is inputted, and the switch part 74 of the control part 8 is turned ON/OFF to thereby achieve/block the power distribution to the heater H.

Figure 4A:
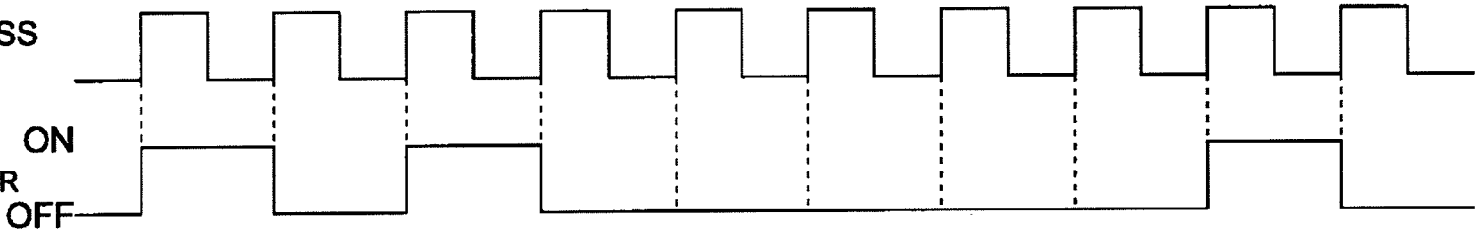
FIG. 4A is a timing chart showing one example of power distribution control of a heater in normal condition in the multi-function peripheral according to the embodiment.
Figure 4B:
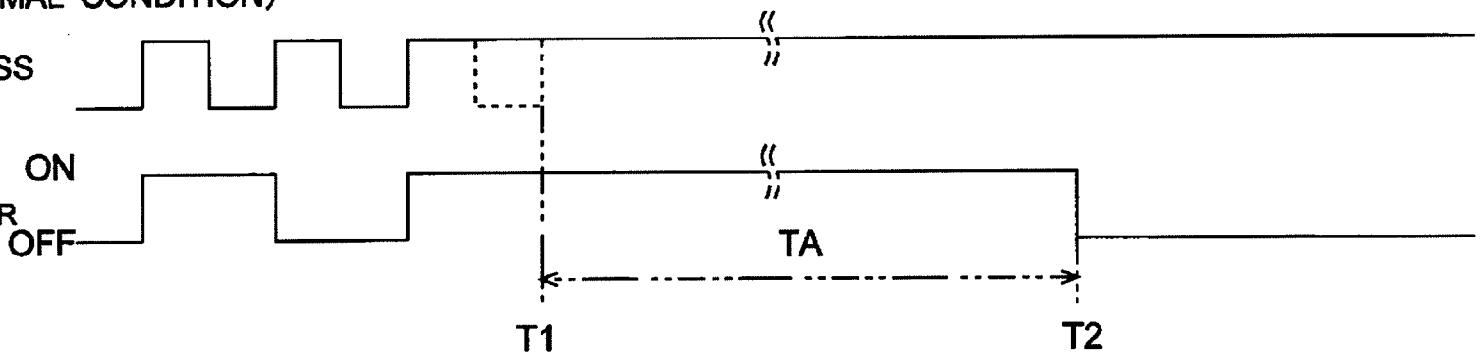
FIG. 4B is a timing chart showing one example of power distribution control of the heater in abnormal condition in the multi-function peripheral according to the embodiment.

Next, based on FIGS. 4A and 4B, examples of control of the power distribution to the heater H in the multi-function peripheral 100 according to the embodiment of the invention will be described. FIG. 4A is a timing chart showing one example of power distribution control of the heater H in normal condition in the multi-function peripheral 100 according to the embodiment of the invention. FIG. 4B is a timing chart showing one example of power distribution control of the heater H in abnormal condition in the multi-function peripheral 100 according to the embodiment of the invention.

First, referring to FIG. 4A, one example of the control of the power distribution to the heater H using the zero cross signal in the normal condition will be described. First, in recent years, there have been demands on image forming apparatuses such as the multi-function peripheral 100, a copier, a printer, and the like for speeding up their printing speeds. The speed-up of the printing speed increases the number of sheets of paper passing through the fixing part 7 per unit of time (for example, one minute). As a result of the paper passage through the fixing part 7, the paper draws heat of the heating roller 71, etc., which easily lowers the temperature of the heating roller 71. On the other hand, in order to promote an increase in the temperature of the heating roller 71 in short time, various ways of increasing the rate of the temperature increase in the heating roller 71 per unit time during the power distribution to the heater H have been devised, including thinning the heating roller 71, achieving efficiency in heating by the heating roller 71, etc. That is, the heating roller 71 has been becoming easier to be cooled on one hand and to be warmed on the other hand. With such a background, the speed-up of the printing speed makes it proportionately more difficult to maintain the fixing part 7 at the fixing control temperature. Therefore, there arises a need for precisely turning ON/OFF the power distribution to the heater H.

The control part 8 switches ON/OFF of the power distribution to the heater H of the fixing part 7 at a rising edge of the zero cross signal. Note that the ON/OFF of the power distribution to the heater H may be switched at a trailing edge of the zero cross signal, but the following description refers to an example in which it is switched at the rising edge.

Specifically, the control part 8, based on the output of the temperature sensor 75, upon detection that the temperature of the fixing part 7 (heating roller 71) has become equal to or lower than the fixing control temperature, turns ON the power distribution to the heater H (turns the switch part 74 into an ON-state) at the rising edge of the zero cross signal. On the other hand, the control part 8, upon detection that the temperature of the fixing part 7 (heating roller 71) has exceeded the fixing control temperature, turns OFF the power distribution to the heater H (turns the switch part 74 into an OFF-state) at the rising edge of the zero cross signal.

The commercial power source is a sine-wave AC and thus its voltage turns to zero twice in one cycle. For example, in case of 60 Hz, the zero cross signal rises 120 times per second. That is, the zero cross signal is a periodical interrupt signal that rises every approximately 8.3 ms (1 second÷120). Based on this interrupt signal, the control part 8 precisely controls the ON/OFF of the power distribution to the heater H.

For example, shown in the timing chart of the normal condition in FIG. 4A is the example in which the ON/OFF of the power distribution to the heater H is repeated at first to fourth rising edges of the zero cross signal, then an OFF state of the power distribution to the heater H is continued at the fifth to eighth rising edges of the zero cross signal, and the power distribution to the heater H is turned ON again at the ninth rising edge of the zero cross signal.

(Abnormality in the Interrupt Signal Generation Part 98)

Next, referring to FIG. 4B, the control of the power distribution to the heater H upon occurrence of abnormality in the interrupt signal generation part 98 according to the embodiment of the invention will be described.

For example, in cases such as a case where a failure has occurred in the interrupt signal generation part 98, as shown in the timing chart of the abnormal condition in FIG. 4B, the zero cross signal may stop (disappear). In the timing chart of the abnormal condition in FIG. 4B, a broken line shows one example of a waveform of the zero cross signal to originally rise. Here, in the multi-function peripheral 100 of this embodiment, the ON/OFF of the power distribution to the heater H is switched at a rising edge of the zero cross signal. Therefore, when the interrupt signal generation part 98 stops and the zero cross signal disappears while the power distribution to the heater H is ON, the power distribution to the heater H remains ON.

When the power distribution to the heater H is kept ON, melting, etc. may occur in members of the fixing part 7, such as the heating roller 71, the pressurizing roller 72, the member supporting each of the rollers, and gears that transmits driving from the motor M. The occurrence of melting consequently requires unit replacement, etc. in the fixing part 7. Moreover, the multi-function peripheral 100 turns into an unusable state.

Thus, the control part 8 that receives input of the zero cross signal as the interrupt signal, upon passage of predetermined time TA (time point T2 shown in the timing chart of the abnormal condition in FIG. 4B) since a time point (Time T1 shown in the timing chart of the abnormal condition in FIG. 4B, and for example, timed by the timer part 83 from the last rising edge) at which the rising edge of the zero cross signal to be inputted disappeared (was found to stop), detects and judges that an error has occurred in the interrupt signal generation part 98. Then the control part 8, upon the judgment that the error has occurred in the interrupt signal generation part 98, forcibly turns OFF the power distribution to the heater H. In other words, the control part 8 turns OFF the power distribution to the heater H through the switch part 74. This can prevent excessive temperature rise from occurring in the fixing part 7 (heating roller 71).

Here, the "predetermined time TA" can be set arbitrarily. For example, where the fixing control temperature is 240 degrees Celsius and, as a result of continuing the power distribution to the heater H for 2.5 seconds at the fixing control temperature, a temperature at which the members inside the fixing part 7 start to melt (a temperature at which an excessive temperature rise state arises, for example, approximately 280° C.) is reached, the predetermined time TA can be set at time less than 2.5 seconds (for example, approximately 2 seconds). In other words, while the heating roller 71 of the fixing part 7 is to be maintained at the temperature suitable for fixing (fixing control temperature) except for in a power-saving mode, the "predetermined time TA" can be set within a range shorter than time when, as a result of the power distribution to the heater H, melting, etc. occur at the heating roller 71, the pressurizing roller 72, the member supporting the heating roller 71, etc. and from the fixing control temperature, a temperature at which the excessive temperature rise is identified is reached.

(Problem at Time of Turning Off the Main Power Source)

Figure 5:
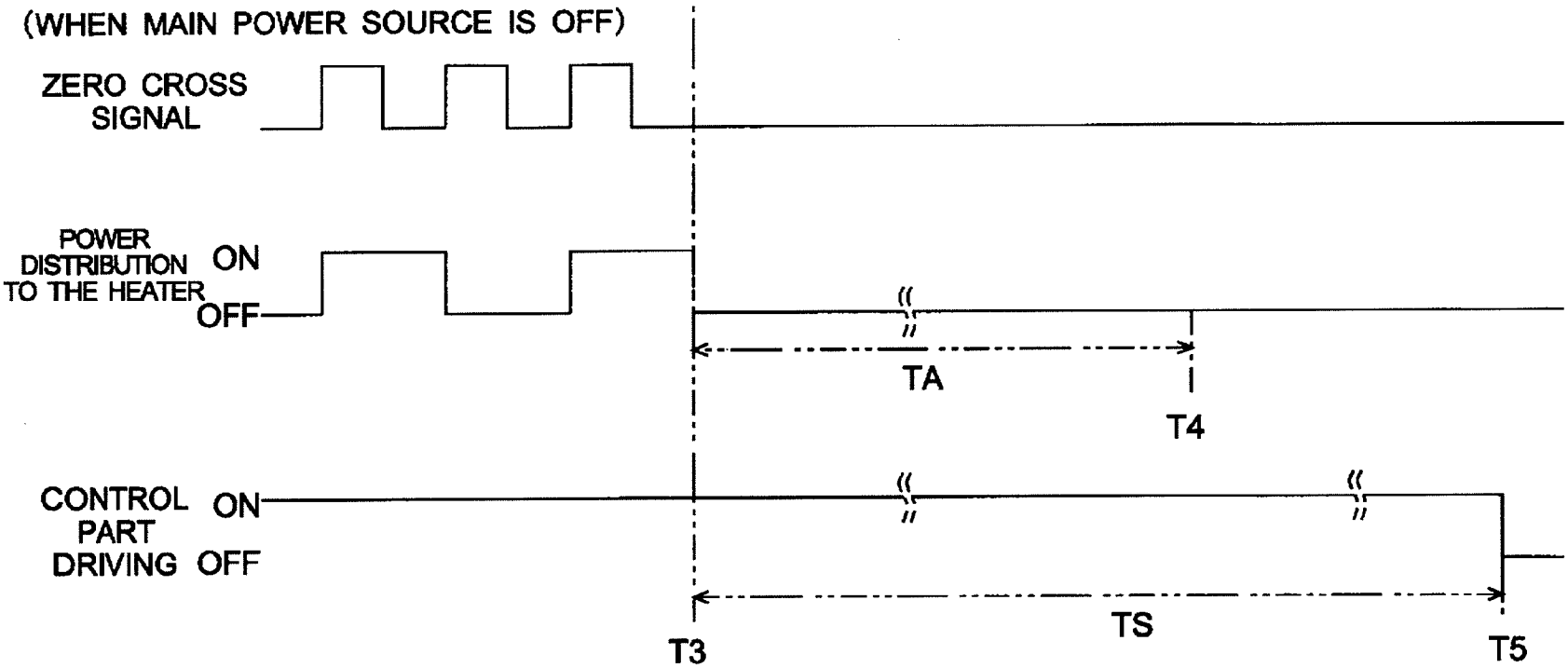
FIG. 5 is a timing chart showing one example of relationship between power distribution to the heater and driving of the control part when a main power source of the multi-function peripheral according to the embodiment is OFF.

Next, based on FIG. 5, a problem occurring at the time of turning OFF the main power source will be described. FIG. 5 is a timing chart showing one example of relationship between the power distribution to the heater H and driving of the control part 8 when the main power source is turned OFF in the multi-function peripheral 100 according to the embodiment of the invention.

First, in the multi-function peripheral 100 of this embodiment, the main power source can be shut OFF by the main switch MS. Then the shutting OFF of the main power source by the main switch MS cuts connection between the multi-function peripheral 100 and the commercial power source (illustrated as a time point T3 in FIG. 5).

When the main power source has been shut OFF, as shown in FIG. 5, the interrupt signal generation part 98 stops the transmission of the zero cross signal. In other words, when the main power source has been shut OFF, a state of a signal line from the interrupt signal generation part 98 to the control part 8 is kept Low. Moreover, when the main power source has been shut OFF, as shown in, FIG. 5, the power distribution to the heater H is consequently also turned OFF.

However, the control part 8 may continue to drive to some extent for a given period of time (for example, several seconds) even when the main power source has been turned OFF by shutting OFF the main switch MS. This is because, as shown in FIG. 3B, an energy-storing element such as the capacitor 96 is arranged in the secondary power source part 92B for the purpose of smoothing the DC voltage, etc. By discharge (energy release) from this capacitor 96 or the like in the power source part 9, when the main power source has been turned OFF, the voltage applied to the control part 8 decreases slowly over time. Then when the voltage applied from the secondary power source part 92B to the control part 8 has become small to a degree at which the CPU 81, etc. can no longer be driven, the driving of the control part 8 stops. In particular, the use of the large-capacity capacitor 96 to obtain smoothing effect results in longer time during which the voltage applied to the control part 8 drops at the time of turning OFF the main power source and thus longer time required for the control part 8 to stop its driving.

Here, the control part 8 receives the zero cross signal from the interrupt signal generation part 98, and upon the passage of the predetermined time TA since the disappearance of the zero cross signal, detects the error. On the other hand, the zero cross signal also disappears when the main power source has been turned OFF. The control part 8 may be still in a driving state even at a time point at which the predetermined time TA has passed since the disappearance of the zero cross signal as a result of turning OFF the main power source. Specifically, driving stop time TS (time point T5) from when the zero cross signal disappears as a result of turning OFF the main power source to when the control part 8 stops its driving is longer than the time point T4 when the predetermined time TA has passed since the disappearance of the zero cross signal as a result of turning OFF the main power source (when a zero cross signal error has been detected). Moreover, setting the predetermined time TA shorter (for example, less than a few tenths of a second) in order to prevent the occurrence of the excessive temperature rise is likely to result in longer driving stop time TS (time point T5) required for the control part 8 to stop its driving.

The "driving stop time TS" differs depending on the type of an image forming apparatus due to differences in power consumption of the control part 8, configuration of the power source part 9, etc., and thus it can be defined by previously recognizing through an experiment or the like time from when the main power source is turned OFF from the state where the main power source is ON to when the control part 8 stops its driving.

Also in the multi-function peripheral 100 of this embodiment, the driving stop time TS (time point T5) from when the zero cross signal disappears as a result of turning OFF the main power source to when the control part 8 stops its driving is longer than the time point T4 at which the predetermined time TA has passed since the disappearance of the zero cross signal as a result of turning OFF the main power source.

In the multi-function peripheral 100 of this embodiment, upon the detection of an error of zero cross signal stop, the storage part 82 stores a history of the error detection. On the other hand, in the multi-function peripheral 100 of this embodiment, the driving stop time TS is longer than the predetermined time TA. In that case, failure to take some countermeasures brings about a problem that the zero cross signal disappears as a result of turning OFF the main power source and the control part 8, despite the absence of an error, erroneously detects that the error of zero cross signal stop has occurred and the storage part 82 leaves the history of occurrence of the error.

Moreover, in the multi-function peripheral 100 of this embodiment, upon the occurrence of the error, the operation panel 1 displays that the error has occurred. In that case, failure to take any countermeasures leads to disappearance of the zero cross signal as a result of turning OFF the main power source, and the control part 8, despite the absence of an error, erroneously detects that the error of zero cross signal stop has occurred, and the operation panel 1 displays that the error has occurred. This erroneous display may lead to misidentification of, for example, breakdown occurrence. Thus, the multifunction printer 100 of this embodiment is characterized in that control is performed considering the erroneous detection of the error of zero cross signal stop when the main power source has been turned OFF. This control will be described below.

(Control Considering the Erroneous Detection of the Error of Zero Cross Signal Stop)

Figure 6:
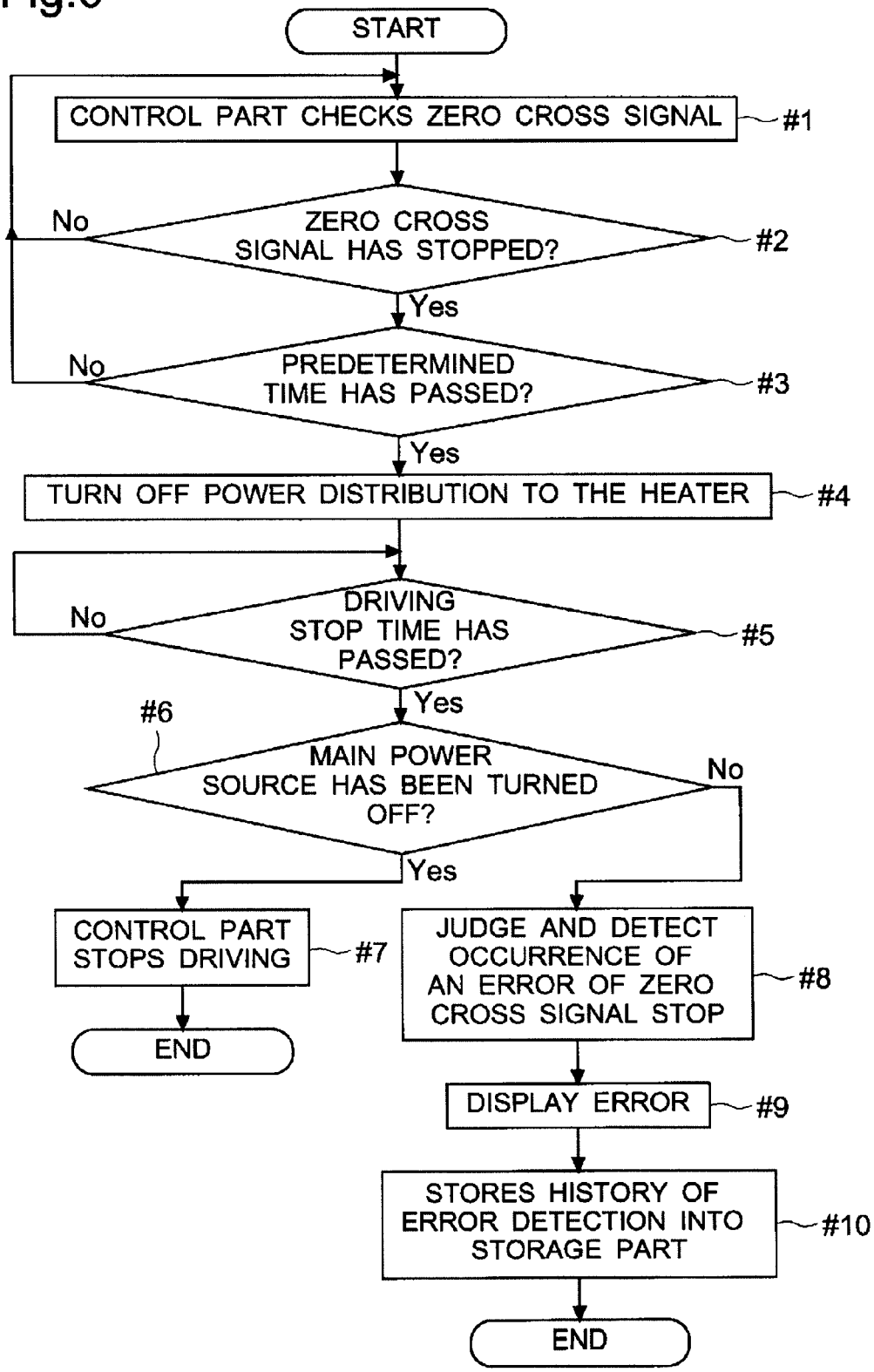
FIG. 6 is a flow chart showing one example of control in view of erroneous error detection of zero cross signal stop when the main power source is OFF in the multi-function peripheral according to the embodiments.

Nest, based on FIG. 6, a description will be given concerning one example of the control considering the erroneous detection of the error of zero cross signal stop when the main power source has been turned OFF in the multi-function peripheral 100 according to the embodiment of the invention. FIG. 6 is a flowchart showing one example of the control considering the erroneous detection of the error of zero cross signal stop when the main power source has been turned OFF in the multi-function peripheral 100 according to the embodiment of the invention.

First, start in FIG. 6 is a time point at which the control part 8 start to drive after the main power source is turned ON by the main switch MS. Then the control part 8 checks input of the zero cross signal from the interrupt signal generation part 98 (step #1).

Next, the control part 8 checks whether or not the zero cross signal from the interrupt signal generation part 98 has disappeared (stopped) (step #2). For example, the control part 8 checks whether or not there is no rising edge of the zero cross signal even after passage of a cycle of the zero cross signal (for example, timed by the timer part 83) since the last rising edge of the zero cross signal. If the zero cross signal has not stopped (No in step #2), the control returns to step #1.

On the other hand, if the zero cross signal has stopped (Yes in step #2), the control part 8 checks whether or not the predetermined time TA has passed since the disappearance (stop) of the zero cross signal (step #3, for example, the predetermined time TA is timed by the timer part 83). If the predetermined time TA has not passed (No in step #3), for example, the control may return to step #1 or a loop of step #3 may be done.

If the predetermined time TA has passed (Yes in step #3), the control part 8 turns OFF the power distribution to the heater H (step #4). Then the control part 8 checks whether or not the driving stop time TS has passed since the disappearance (stop) of the zero cross signal (step #5). If the driving stop time TS has not passed (No in step #5), the control part 8 continues the check until the driving stop time TS passes (a loop of step #5).

On the other hand, if the driving stop time TS has passed (Yes in step #5) and if the main power source has been turned OFF by the main switch MS (Yes in step #6), the power supply from the outside to the multi-function peripheral 100 is physically blocked and thus the control part 8 stops its driving (step #7). As a result, the control ends without displaying the error of the zero cross signal onto the operation panel 1 and storing the history of the error detection into the storage part 82. Since the control part 8 stops its driving as a result of the passage of the driving stop time TS, there is no need for detecting whether or not the main power source has been turned OFF by the main switch MS.

On the other hand, if the main power source has not been turned OFF (No in step #6), the control part 8 judges and detects that the error of zero cross signal stop has occurred (step #8). Specifically, the control part 8, based on the interrupt signal (zero cross signal) from the interrupt signal generation part 98, controls the ON/OFF of the power distribution to the heater H and also turns OFF the power supply to the heater H upon passage of the predetermined time TA since the disappearance of the interrupt signal (zero cross signal) from the interrupt signal generation part 98, and then judges that the error has occurred if the control part 8 is still driving after passage of the driving stop time TS, longer than the predetermined time TA, from the turning-OFF of the main switch MS until the control part 8 stops its driving after the disappearance of the interrupt signal (zero cross signal) from the interrupt signal generation part 98.

Then the control part 8 displays on the operation panel 1 the fact that the error has occurred (step #9). That is, the control part 8 displays the error occurrence on the operation panel 1 in a case where it has judged that the error has occurred and it is still driving. Moreover, the control part 8 stores into the storage part 82 a history indicating the fact that the error of zero cross signal stop has been detected (step #10). That is, the control part 8, in a case where it has judged that the error has occurred and it is still driving, stores the history of the error occurrence into the storage part 82. If there is no zero cross signal, the ON/OFF of the power distribution to the heater H cannot be controlled, and thus the control ends.

As described above, in the multi-function peripheral 100 of this embodiment, the power distribution to the heater H is turned OFF upon the passage of the predetermined time TA since the disappearance of the interrupt signal (for example, zero cross signal). As a result, regardless of whether or not there is power supply from the outside, the power distribution to the heater H is reliably turned OFF. For example, even when the power supply from the outside is continued and failure of the interrupt signal generation part 98, disconnection of a signal line from the interrupt signal generation part 98 to the control part 8, or any other failure occurs, the power distribution to the heater H is reliably turned OFF. Therefore, occurrence of excessive temperature rise at the fixing part 7 attributable to, for example, the failure of the interrupt signal generation part 98 can be prevented.

Further, if the control part 8 is still driving after the passage of the driving stop time TS for the control part 8 since the disappearance of the interrupt signal, the control part 8 judges that the error has occurred. As a result, even when the main power source has been turned OFF, the control part 8 continues its driving to same degree for a certain period of time, thereby preventing unnecessary operations from being performed. As described above, regardless of whether the main power source is ON or OFF and regardless of abnormality in the interrupt signal generation part 98, the excessive temperature rise at the fixing part 7 is prevented, and unnecessary operations as a result of the erroneous error detection of the interrupt signal stop are not performed. Moreover, without requiring any special structure, these effects can be provided only by software control by the control part 8, which is also advantageous in terms of manufacturing costs.

If the control part 8 is still driving after the passage of the driving stop time TS for the control part 8 since the disappearance of the interrupt signal, the control part 8 displays on a display part (the operation panel 1) the fact that the error has occurred. As a result, when the main power source is OFF, the continuous driving of the control part 8 can prevent the error display by the erroneous detection. Therefore, when the main power source has been turned OFF, erroneous identification of, for example, failure occurrence, can be prevented.

Moreover, if the control part 8 is still driving after the passage of the driving stop time TS for the control part 8 since the disappearance of the interrupt signal, the control part 8 stores into the storage part 82 the history of the error occurrence. As a result, when the main power source has been turned OFF, the control part 8 continues its driving to some degree for a certain period of time, thereby preventing the history of the error occurrence from being stored. Therefore, when the main power source has been turned OFF, the history of the error occurrence based on the erroneous detection is never accumulated into the storage part 82. That is, the unnecessary history of the error occurrence can be prevented from being left. Moreover, in a case where the control part 8 drives in response to an DC voltage from the power source part 9, even when the control part 8 continues its driving as a result of the discharge from the capacitor 96 when the main power source has been turned OFF, the unnecessary operations such as the error display and the storage of the history of the error occurrence can be prevented from being performed. Moreover, even in a case where the interrupt signal generation part 98 generates the zero cross signal, even under the presence of an abnormality such as failure of the interrupt signal generation part 98 or disconnection of a signal line, etc. transmitting the interrupt signal to the control part 8, the power distribution to the heater H is reliably turned OFF. When the main power source has been turned OFF, even when the control part 8 continues its driving, the unnecessary operations can be prevented from being performed.

The above embodiment has been described, referring to, as an example, the fixing part 7 provided with the heating roller 71 and the pressurizing roller 72, but this embodiment is also applicable to an image forming apparatus provided with a fixing part 7 which has a built-in heater H and which heats and pressurizes a toner image with a belt and a film.

The invention can also be considered as an image forming apparatus control method, as shown in FIG. 6.

The embodiment of the invention has been described above, but the scope of the invention is not limited to this, and various modifications can be made within a range not departing from spirits of the invention.

What is claimed is:

1. An image forming apparatus comprising:

a fixing part including: a heating body incorporating a heater heated through power distribution, the heating body heating paper with a toner image transferred thereon, and a pressurizing body making pressure-contact with the heating body and pressurizing the paper with the toner image transferred thereon;

a power source part receiving power from outside, and then supplying power to the heater and also generating a voltage for driving a control part;

a main switch for turning ON/OFF the power supply from the outside to the power source part;

an interrupt signal generation part generating a periodical interrupt signal based on the power supplied from the outside; and a control part controlling ON/OFF of the power distribution to the heater based on the generation of the interrupt signal by the interrupt signal generation part, wherein the control part also turns OFF the power supply to the heater upon passage of a predetermined time since disappearance of the interrupt signal, the control part judges that an error has occurred when it is still driving after passage of a driving stop time since the disappearance of the interrupt signal, and the driving stop time is a time by which the driving part would stop driving after the main switch were turned OFF, and is longer than the predetermined time since the disappearance of the interrupt signal.

2. The image forming apparatus according to claim 1, wherein a display part performing display is provided; and the control part, upon the judgment that the error has occurred, displays the error occurrence on the display part.

3. The image forming apparatus according to claim 2, wherein a storage part is provided which, upon the error occurrence, stores the error occurrence as a history, and the control part, when still driving upon the judgment that the error has occurred, stores a history of the error occurrence into the storage part.

4. The image forming apparatus according to claim 1, wherein a storage part is provided which, upon the error occurrence, stores the error occurrence as a history, and the control part, when still driving upon the judgment that the error has occurred, stores a history of the error occurrence into the storage part.

5. The image forming apparatus according to claim 1, wherein the power source part has a capacitor and, based on the power supplied from the outside, performs rectification and stepping down to generate a voltage for driving the control part.

6. The image forming apparatus according to claim 5, wherein the power source part receives power supply from a commercial power source, and the interrupt signal generation part, based on a voltage of the commercial power source, generates a zero cross signal as the interrupt signal.

7. The image forming apparatus according to claim 1, wherein the power source part receives power supply from a commercial power source, and the interrupt signal generation part, based on a voltage of the commercial power source, generates a zero cross signal as the interrupt signal.

8. A image forming apparatus control method comprising steps of:

receiving, with a power source part, a power supply from an outside source;

supplying power from the power source part to a heater;

generating a voltage, with the power source part, to drive a control part;

controlling ON/OFF states of heating the heater by power distribution with the control part, based on a periodical interrupt signal generated by an interrupt signal generation part with power supplied from the outside source;

turning OFF power supply to the heater with the control part, upon passage of a predetermined time since disappearance of the interrupt signal; and judging that an error has occurred with the control part, when it is determined that the control part is still driving after passage of a driving stop time since the disappearance of the interrupt signal, wherein the driving stop time is a time by which the driving part would stop driving after a main switch for turning ON/OFF power supply from the outside source were turned OFF, and is longer than the predetermined time since the disappearance of the interrupt signal.

9. The image forming apparatus control method according to claim 8, further comprising, upon the judgment that the error has occurred, displaying the error occurrence on a display part.

10. The image forming apparatus control method according to claim 9, further comprising, upon the judgment that the error has occurred, storing, into a storage part storing error occurrence as a history, the history of the error occurrence.

11. The image forming apparatus control method according to claim 8, further comprising, upon the judgment that the error has occurred, storing, into a storage part storing error occurrence as a history, the history of the error occurrence.

12. The image forming apparatus control method according to claim 8, wherein the power source part has a capacitor, and the method further comprises performing rectification and stepping down with the power source part, based on the power supplied from the outside, to generate the voltage for driving the control part.

13. The image forming apparatus control method according to claim 12, wherein the outside source from which the power source part receives power supply from is a commercial power source, and the method further comprises generating a zero cross signal as the interrupt signal with an interrupt signal generation part, based on a voltage received from the commercial power source.

14. The image forming apparatus control method according to claim 8, wherein the outside source from which the power source part receives power supply from is a commercial power source, and the method further comprises generating a zero cross signal as the interrupt signal with an interrupt signal generation part, based on a voltage received from the commercial power source.

* * * * *